US007045976B2

(12) United States Patent
Gissot et al.

(10) Patent No.: US 7,045,976 B2
(45) Date of Patent: May 16, 2006

(54) HIGH DEFINITION ELECTRON GUN FOR CATHODE RAY TUBE

(75) Inventors: Grégoire Gissot, Plombière les Dijon (FR); Nicolas Richard, Dijon (FR); Nicolas Gueugnon, Dijon (FR); Pierre Bizot, Marsannay la Cote (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/848,956

(22) Filed: May 19, 2004

(65) Prior Publication Data

US 2004/0232858 A1 Nov. 25, 2004

(30) Foreign Application Priority Data

May 23, 2003 (EP) ..... 0306199

(51) Int. Cl.
*H01J 29/62* (2006.01)

(52) U.S. Cl. ..... 315/368.16; 315/382; 315/15; 313/411; 313/449

(58) Field of Classification Search ..... 315/14–16, 315/366, 368.15, 368.16, 370, 382, 382.1, 315/411; 313/411–415, 446–449
See application file for complete search history.

(56) References Cited

U.S. PATENT DOCUMENTS 5,027,043 A * 6/1991 Chen et al. ..... 315/368.11
5,055,749 A * 10/1991 Chen et al. ..... 315/368.11
5,170,101 A 12/1992 Gorski et al. ..... 315/368.11
5,404,071 A 4/1995 Son ..... 313/414
5,539,285 A 7/1996 Iguchi et al. ..... 315/382
2002/0096989 A1 7/2002 Steinhauser ..... 313/414
2005/0052110 A1* 3/2005 Gueugnon et al. ..... 313/414

FOREIGN PATENT DOCUMENTS

EP 0899768 A2 3/1999

* cited by examiner

*Primary Examiner*—Haissa Philogene
(74) *Attorney, Agent, or Firm*—Joseph S. Tripoli; Harvey D. Fried; Richard LaPeruta, Jr.

(57) ABSTRACT

Electron gun for cathode ray tube comprising aligned in series along an axis XX' an electron-emitting cathode K, electrodes G1 and G2 for the formation of an electron beam, a prefocusing electron lens G3, G4, G5, a first quadripolar device G7, G8 electrically controlled in a dynamic manner in synchronism with the screen scan so as to correct beam focusing defects at the screen edge, a main electron lens G8–G9 making it possible to focus the electron beam onto a screen.

It also comprises a second quadripolar device G5, G6, G7situated between the prefocusing electron lens G3, G4 and the first quadripolar device and comprising electrodes G5, G6, G7exhibiting rectangular apertures. Those of G5 and G7 are parallel and those of G6 are orthogonal to those of G5 and G7.

The electrodes G5 and G7 are placed at a fixed polarization potential, and the electrode G6 is at a polarization potential varying in synchronism with the screen scan.

6 Claims, 4 Drawing Sheets

HIGH DEFINITION ELECTRON GUN FOR CATHODE RAY TUBE

The invention relates to an electron gun for cathode ray tube and in particular to a high-definition electron gun for a colour television tube.

BACKGROUND OF THE INVENTION

A conventional television tube comprises an almost plane faceplate or screen of rectangular shape. The screen is furnished on its internal face with a mosaic of patches of phosphors or pixels which excited by an electron beam emit light which may be blue, green or red, depending on the phosphor excited.

An electron gun sealed in the envelope of the tube is directed towards the centre of the screen and makes it possible to emit the electron beam towards the various points of the screen through a perforated mask (or shadow mask). The electron gun makes it possible to focus the electron beam onto the internal face of the screen carrying the phosphors.

A deviating system placed around or on either side of the tube makes it possible to act on the direction of the electron beam so as to deviate its trajectory. Continual action of the deviating system thus allows horizontal and vertical scanning of the screen so as to explore the entire mosaic of phosphors.

Without deviation of the electron beam and with symmetric electrodes of the gun that create symmetric electric fields in the gun, the electron beam reaches the centre of the screen and the spot formed is circular.

When the deviating system is acted on and the direction of the beam is deflected, the spot on the screen is deformed and the problem is all the more crucial as the beam is deflected towards the periphery of the screen or even towards the corners of the screen. In particular, in the case of a rectangular screen whose large dimension is horizontal, a horizontal deflection towards the left and right edges gives rise to a horizontally deformed spot. In the corners there is a vertically and horizontally combined deformation.

To remedy these defects, the art makes provision for electrodes made in the form of quadripoles and controlled electrically in different ways in the vertical direction and in the horizontal direction, doing so in order to precompensate for the deformations of the beam just described.

The quadripolar effects thus make it possible to achieve shape factors for the electron beams. These effects tend to counter the phenomena of distortion of shapes of beams created by the deviator in a situation of deviation towards the periphery of the screen and hence of deformation of size of spot on the screen. The shape factor must be dynamic as a function of the deviation of the beam.

The horizontal distortion of the electron beam towards the periphery of the screen is therefore the result of a magnetic deflection caused by the deviator deflecting the beam so as to effect the scanning of the screen, and associated with this deviator the action of an exit quadripole in the gun. The combining of these effects results in a degradation of the horizontal resolution and a large improvement in the vertical resolution.

As is represented in FIG. 2*a*, the electric lines of force are therefore oriented in the direction of the arrows 4 and the electron beam undergoes a force of compression 2 in the horizontal plane and of distortion 3 in the vertical plane. Starting from the principle that an electron beam must preferably occupy a large enough surface area in the plane of a principal exit lens of an electron gun to obtain a best possible resolution and that the size of the beam at the screen edge is not optimal for good resolution, a problem to be solved arises.

Among the various possibilities of structures, a quadripole structure using three electrodes is used. Such is the case for example of the structure described in patent U.S. Pat. No. 5,027,043. In this system, the entrance and exit electrodes are at a variable potential, this giving rise to an alteration of the optical properties of the lenses upstream and downstream of this system. The object of the invention is therefore to improve the shape of the spot at the screen edge on a high-definition television screen and in particular to increase the horizontal dimension of the electron beam in the principal lens of the gun. To do this, the invention makes provision to fit a quadripolar device making it possible to cancel the undesirable effects produced by the quadripolar device fitted at the exit of the gun and by the deviator.

BRIEF SUMMARY OF THE INVENTION

The invention therefore relates to an electron gun for cathode ray tube comprising aligned in series along an axis:

- an electron-emitting cathode,
- a first electrode and a second electrode effecting the formation of an electron beam and being focused to a so-called crossover point,
- an electron lens for prefocusing the electron beam,
- a first quadripolar device electrically controlled in a dynamic manner in synchronism with the screen scan so as to correct beam focusing defects at the screen edge,
- a main electron lens making it possible to focus the electron beam onto a screen.

This gun furthermore comprises a second quadripolar device situated between the prefocusing electron lens and the first quadripolar device and comprising, disposed parallel to one another and in series along the axis:

- a first electrode exhibiting at least one rectangular aperture whose large sides are oriented in a first direction,
- a second electrode exhibiting at least one rectangular aperture whose large sides are oriented in a second direction orthogonal to the first,
- a third electrode exhibiting at least one rectangular aperture whose large sides are oriented in the first direction, the first electrode and the third electrode being placed at a fixed polarization potential, the third electrode being at a polarization potential varying in synchronism with the screen scan.

The screen being of rectangular shape, the first direction of orientation of the large sides of the apertures of the electrodes of the first and the third electrode of the second quadripolar device is parallel to the large sides of the screen.

According to a preferred embodiment of the invention, the first and the third electrode of the second quadripolar device are at one and the same distance d from the second electrode.

Moreover, provision may advantageously be made for the distance d and the focal lengths Fo of the second quadripolar device to be connected by the relation:

$$Fo=ao+a\mathbf{1}.d+a\mathbf{2}.L+a\mathbf{3}.H+a\mathbf{12}.d.L+a\mathbf{23}.L.H+a\mathbf{22}.L+a\mathbf{33}.H^2$$

in which:

L is the length of a large side of the apertures of the electrodes of the second quadripolar device, H is the length of a small side of the apertures of the electrodes of the second quadripolar device, ao, a1, a3, a12, a23, a22, a33 are constants.

Moreover, the distance d1 of the second quadripolar device from the first quadripolar device is connected to the distance d2 of the first quadripolar device from the main electron lens by the relation:

$$(Gtmin-ao-a1.d1)/a2 \leqq d2 \leqq (Vdmax-bo-b1.d1)/b2$$

in which:

Gtmin is the minimum transverse magnification,

Vdmax is the maximum dynamic voltage applied to the second quadripolar device, a0, a1, b0, b1, d1 and d2 are constants.

According to one embodiment of the invention, the large sides of the apertures of the electrodes possess recesses of circular shapes whose radius R is equal to:

$$R=(H/2)/\cos(\alpha.\pi/2)$$

with:

H: distance between the two large sides of an aperture

α: percentage of the perimeter of the circle of radius R.

BRIEF DESCRIPTION OF THE DRAWINGS

The various aspects and characteristics of the invention will become more clearly apparent in the description which follows and in the appended figures which represent.

DESCRIPTION OF PREFERRED EMBODIMENTS

Figure 1A:
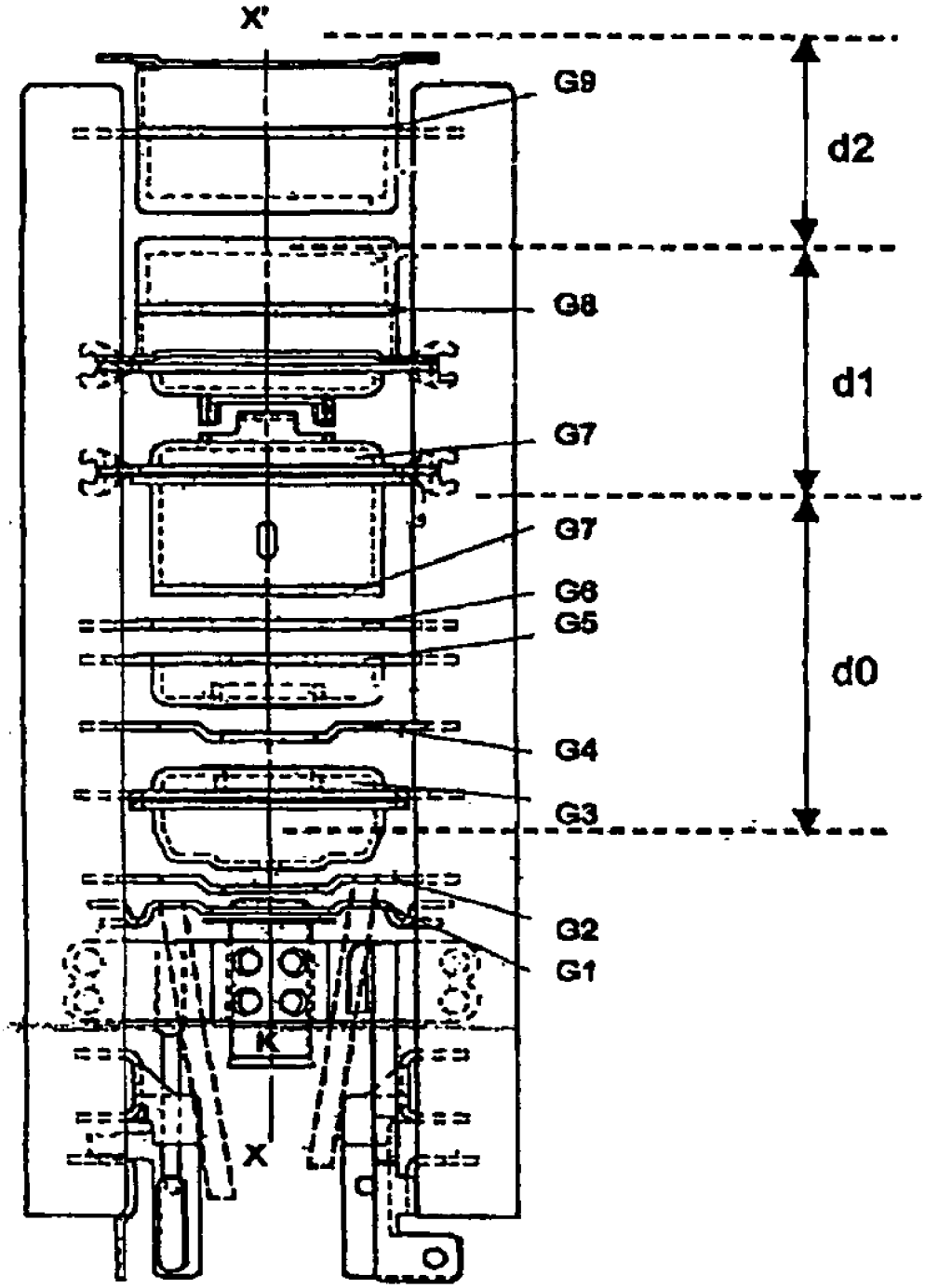
FIGS. 1*a* and 1*b*, an exemplary embodiment of an electron gun for cathode ray tubes according to the invention, applicable to high-definition guns, FIGS. 2*a* and 2*b*, schematics illustrating quadripolar effects induced on the shape of an electron beam emitted by an electron gun, FIGS. 3 and 4, an exemplary embodiment of a quadripolar device according to the invention, FIG. 5, a diagram illustrating the respective positions of the quadripolar devices of the gun according to the invention, FIG. 6, an aperture of an electrode of a quadripolar device.

Referring to FIG. 1, an exemplary embodiment of an electron gun according to the invention will therefore be described.

This electron gun comprises a cathode K emitting electrons by thermoemission. An electrode G1 in cooperation with the electrode G2 initializes the formation of an electron beam along the axis XX' from the electrons emitted by the cathode.

The electrode G2 focuses the beam thus constructed to a focusing point, called the "crossover". The size of this focusing point is as point-like as possible. By way of example, the electrode G1 is at a static potential lying between earth and 100 volts. The electrode G2 is at a potential lying between 300 volts and 1200 volts.

The electrode G3 raised, according to this example, to a potential of between 6000 and 9000 volts helps to accelerate the electrons.

The electrode G4 raised to a potential substantially equivalent to that of the electrode G2 constitutes with the electrode G3 and the part of the electrode G5 facing G4 a prefocusing electron lens for the electron beam.

The electrodes G5, G6 and G7 constitute quadripolar lenses and will induce a quadripolar effect on the beam in such a way as to exert a compressive load on the electron beam in the vertical plane and a distortion in the horizontal plane. As described previously, the deformations of the beam are bigger at the periphery of the screen and in particular at the corners of the screen. They increase continuously from the centre of the screen to the periphery. The set of electrodes or quadripole G5, G6, G7 must therefore carry out a precorrection as a function of the deviation of the beam. This correction must therefore be carried out continuously in synchronism with the screen scanning system. The makeup of the quadripoles created by G5, G6, G7 and the control of the electrodes will be described later.

Figure 2A:
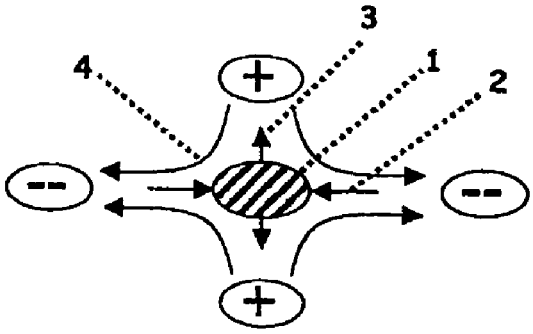

The device G7–G8 achieves a quadripolar effect which tends to exert on the electron beam a compressive load in the horizontal plane and a distortion in the vertical plane as was described in relation to FIG. 2*a*.

The electrode G9 is the electrode which together with G8 constitutes the principal exit lens.

Figure 1B:
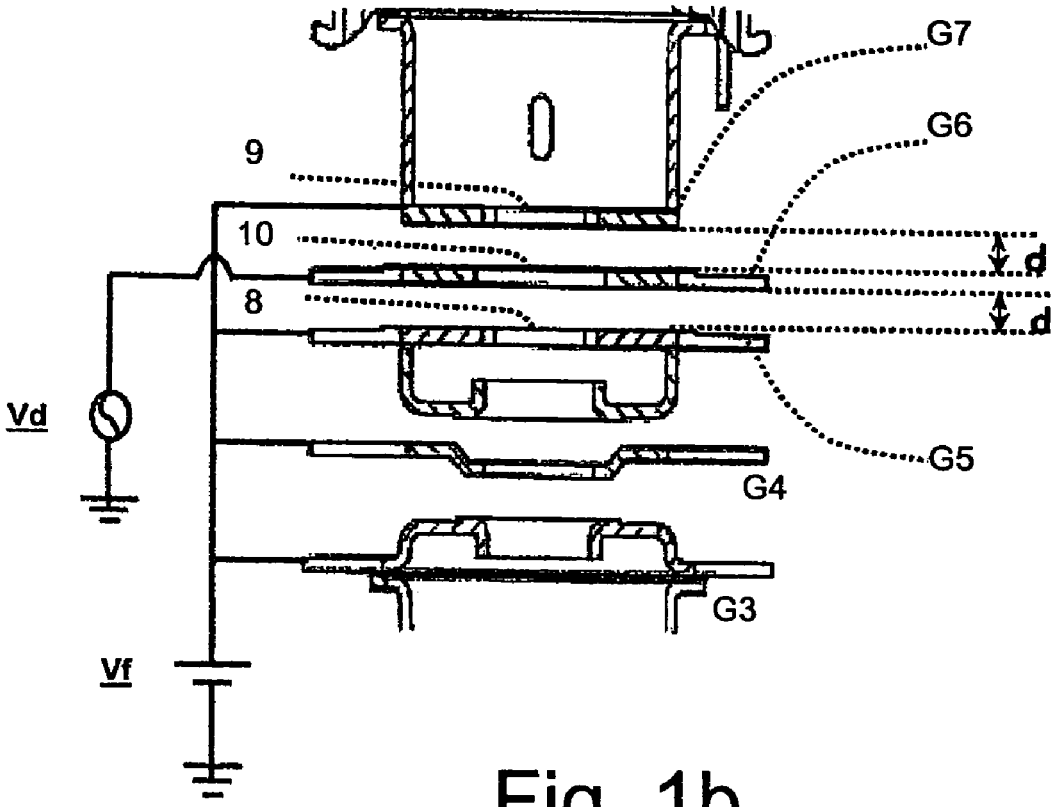

FIG. 1*b* represents in greater detail an exemplary embodiment of the quadripolar device made up essentially of the electrodes G5, G6, G7. This exemplary embodiment is applied to a gun making it possible to obtain a three-colour tube. Each electrode plane therefore comprises three electrodes and the electron gun therefore processes three electron beams.

The electrodes G3 and G4 appear again in this figure.

The electrode G6 is situated at equal distances from the electrodes G5 and G7.

The electrodes G5 and G7 are raised to one and the same fixed potential which is for example between 6000 and 9000 volts.

The electrode G6 receives a variable potential also called a dynamic potential which varies in synchronism with the line scan. The dynamic voltage Vd varies, for example, between almost 0 volts and up to 2000 volts. The electrode G6 is at a potential V6=V5+Vd. At the centre of the screen the potential of the electrode G6 equals V6=V5=V7=Vf. The dynamic voltage Vd (0–2000V) is applied to the electrode G6 in a situation of deflection of the electron beams. The voltage of the electrode G6 is therefore the sum of Vf+vd=V6 in the corners and at the periphery.

Figure 3:
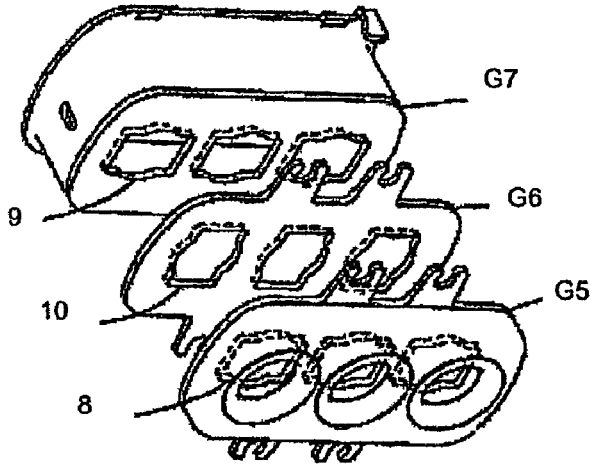
Figure 4:
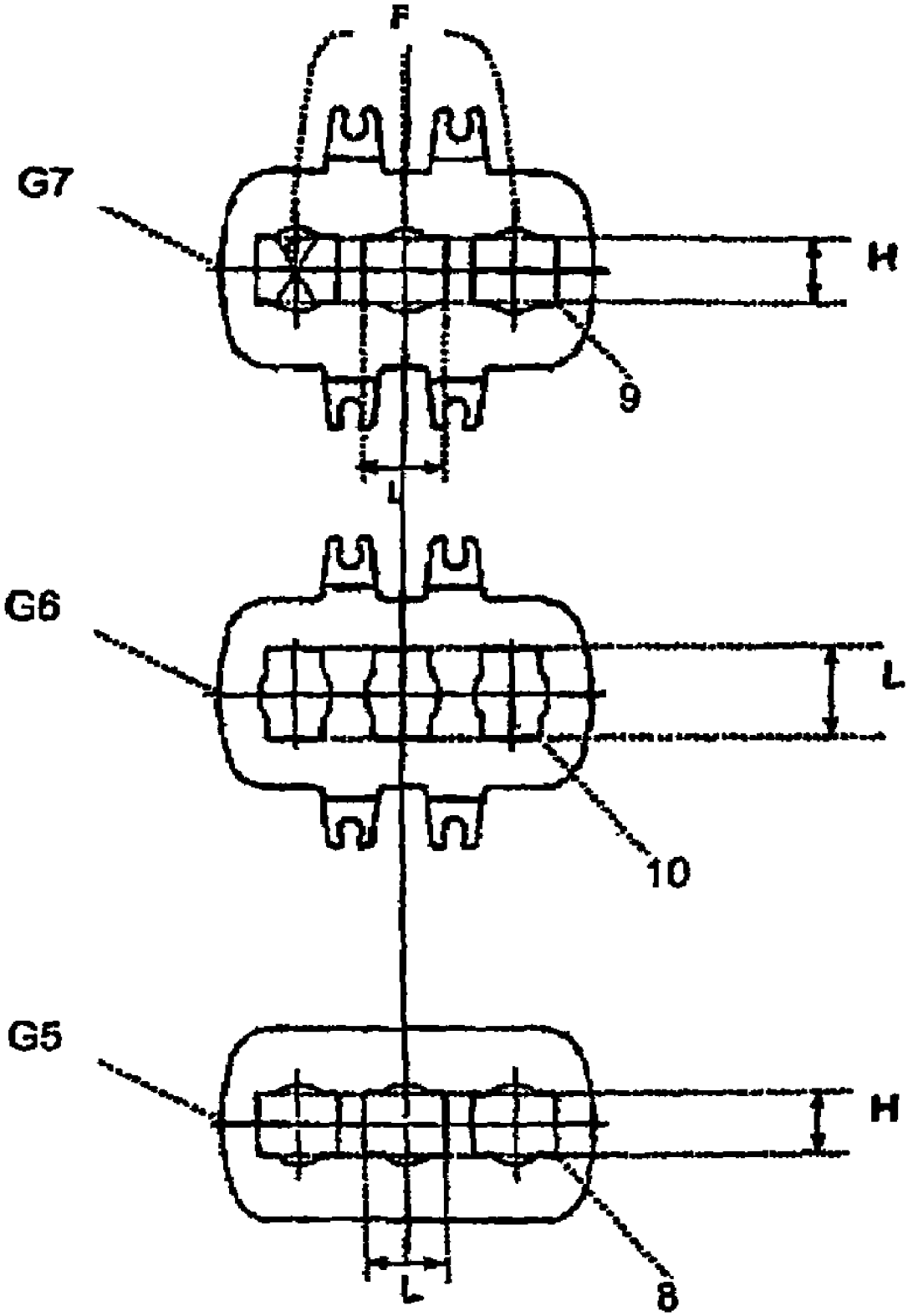

The shapes of the various electrodes G5, G6 and G7 are represented in FIGS. 3 and 4.

Each electrode comprises an aperture 8, 9, 10 respectively of rectangular general shape. Each large side of these apertures comprises a widening in the form of an arc of a circle useful for mounting the electrodes and the shape of which will be specified later.

The apertures 8, 9 and 10 are identical or almost identical. The smallest dimension of these apertures has the value H and the largest dimension has the value L.

The electrodes G5 and G7 have their apertures 8 and 10 oriented in such a way that their large dimensions are horizontal whereas the electrode G6 has its apertures oriented with its large dimensions vertical, that is to say perpendicular to the apertures 8 and 9 of the electrodes G5 and G7. The surfaces of the widening in the form of arcs of circles have the same dimensions for the various apertures of the three electrodes.

The quadripolar device as a whole possesses vertical and horizontal focal lengths Fo and is designed so that these focal lengths make it possible to obtain high-definition resolution.

The focal length Fo is determined on the basis of the dimensions L and H of the apertures of the electrodes G5 to G7 and of the distance d between the electrodes G5–G6 and G6–G7. The variation in the focal length Fo is expressed in mathematical form by a second-degree approximate polynomial model applicable throughout the domain of variability of the parameters (d, L, H). Thus the value of Fo can be written in the form:

$$Fo=ao+a1.d+a2.L+a3.H+a12.d.L+a23.L.H+a22.L^2+a33.H^2$$

The coefficients ao to a33 have constant values which depend on the ranges of values chosen for D, L and H. Other parameters also come into the determination of these coefficients. The following are for example involved:

the relative value α of the widenings in the form of arcs of circles mentioned previously with respect to the dimension L of the apertures. This coefficient α will be made explicit later in relation to FIG. 6.

The permitted estimation error and other accuracy coefficients.

By way of example for the following parameter values:

0.9 mm<d<1.5 mm 4.0 mm<L<5.5 mm 2.9 mm<H<3.5 mm

α# 42%

R-squared (adjusted for the dof values)=99.3577%

Standard error of estimation=0.827391

Mean absolute error=0.525942

Durbin-Watson statistic=2.16192 (P=0.0851)

Residual autocorrelation of order 1=−0.109116

The following values of the coefficients a0 to a33 were obtained:

ao=36.8; a1=−22.5; a2=11.5; a3=−43.5; a12=9.3; a13=−12.1; a22=−11.3; a23=35.5; a33=−25.0

Figure 5:
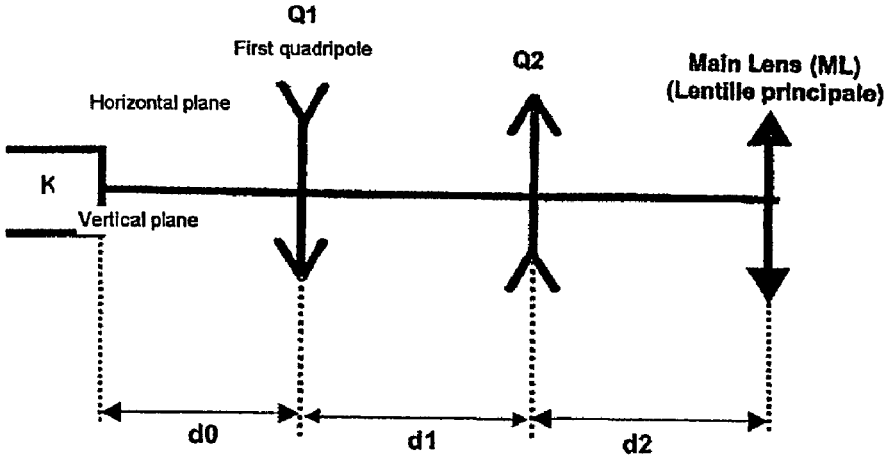

Furthermore, as is represented in FIGS. 1 and 5, the quadripolar device constituted by the set of electrodes G5, G6, G7 is positioned at a distance d0 with respect to the cathode K and at a distance d1 with respect to the quadripolar exit device while the latter is at a distance from the principal exit lens.

In a general manner the length of the electron gun corresponding to d0+d1+d2 is a design datum. We will preferably have 32 mm<d0+d1+d2<36 mm. A common value is around 34 mm.

The determination of the values d0, d1 and d2 depends in particular on the level of the dynamic voltage Vd applied to the quadripole G5-G6-G7 (dynamic voltage applied to the two quadripoles) and the optical transverse magnification Gt.

The choice of the two criteria (dynamic voltage Vd, transverse magnification Gt) is consequent upon the analytical study of the "high definition" gun. The estimated values are somewhat different from the reality but have allowed a relative positioning of the quadripoles used in our gun.

The variation of the transverse magnification is expressed in the form of a simple polynomial:

$$Gt=ao+a1*d1+a2*d2$$

And the dynamic voltage applied to the quadripole G5-G6-G7 is expressed in the form of the polynomial:

$$Vd=bo+b1*d1+b2*d2$$

In these relations the coefficients a0 to b2 can have, by way of example, the following values:

a0=−25.74 a1=+0.51 a2=+0.27 b0=+470.21 b1=+34.04 b2=+27.17

Within the framework of an exemplary application, we may advantageously fix:

Vd≦Vdmax with Vdmax=1100 Volts

Gt≧Gtmin with Gtmin=−17.5

The above relations may be written:

$$Vd=bo+b1*d1+b2*d2\leqq Vd\max \quad (1)$$

$$Gt=ao+a1*d1+a2*d2\geqq Gt\min \quad (2)$$

We will therefore have:

$$(Gt\min-ao-a1.d1)/a2<d2\leqq(Vd\max-bo-b1.d1)/b2$$

If d1 varies from 11 mm to 14 mm:

11 mm≦d1≦14 mm

The distance d2 can be chosen in the following way for various values of d1:

| d1 in mm | d2 min in mm | d2 max in mm |
|---|---|---|
| 11 | 9.7 | 10.7 |
| 11.09 | 9.5 | 10.5 |
| 12 | 7.8 | 9.3 |
| 13 | 5.8 | 7.8 |
| 14 | 3.9 | 6.4 |

Figure 2B:
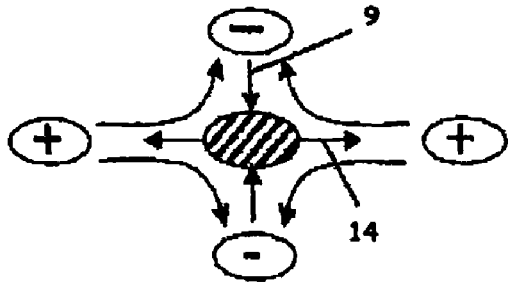

Such a device thus described makes it possible to obtain a very big effect as represented in FIG. 2*b* and which operates in opposition relative to the effect represented in FIG. 2*a*. The obtaining of a vertical force of compression 9 of the electron beam and of distortion in the horizontal plane may be seen.

Figure 6:
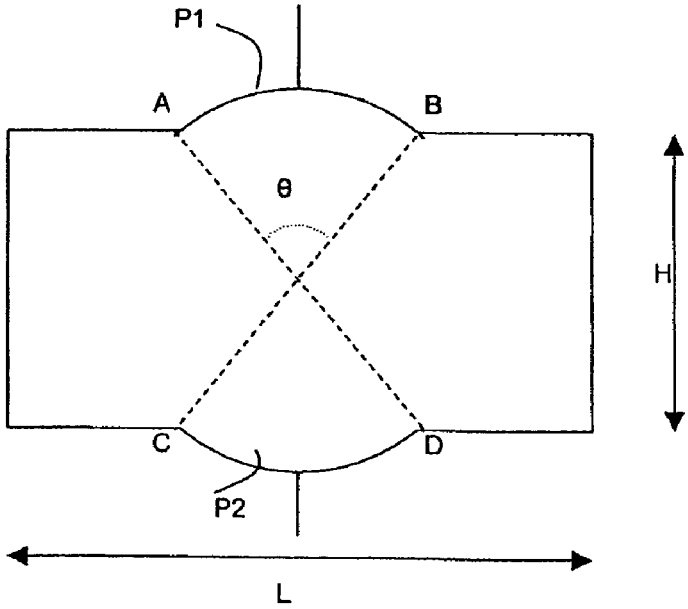

As was mentioned previously, the widenings of the apertures 8, 9, 10 in the form of arcs of circles may be computed. Referring to FIG. 6, the way in which these widenings are determined will be described.

It is firstly noted that the distance P1 between the points A and B of the aperture is preferably equal to the distance between the points C and D. α denotes the percentage of an arc of a circle with respect to the perimeter of a circle of radius R, the sum of the lengths of the arcs of circle AB and CD is $$P=\alpha.\pi.R$$

The length of an arc of a circle being given by the formula P=R.θ and that we have θ=απ

For a specified dimension H of an aperture of an electrode, there must be a widening of the apertures of radius R such that the following relation is complied with:

$$R=(H/2)/\cos(\alpha.\pi/2)$$

What is claimed is:

1. An electron gun for cathode ray tube comprising aligned in series along an axis:

an electron-emitting cathode, a first electrode and a second electrode effecting the formation of an electron beam and being focused to a so-called crossover point, an electron lens for prefocusing the electron beam comprising three successive electrodes: G3, a first quadripolar device electrically controlled in a dynamic manner in synchronism with a screen scan so as to correct beam focusing defects at a screen edge, a main electron lens making it possible to focus the electron beam onto a screen, the gun also comprising a second quadripolar device comprising a first electrode, a second electrode and a third electrode, the second quadripolar device being situated between the prefocusing electron lens and the first quadripolar device, characterized in that:

the second electrode of the second quadripolar device exhibits apertures of substantially rectangular shape whose large sides are oriented in a first direction, the first and third electrodes of the second quadripolar device exhibit facing the second electrode apertures of substantially rectangular shape whose large sides are oriented in a second direction orthogonal to the first direction, the first electrode and the third electrode being placed at a fixed polarization potential, the second electrode being at a polarization potential varying in synchronism with the screen scan.

2. Electron guns according to claim 1, characterized in that the screen is of rectangular shape and has its large sides oriented parallel to the direction of orientation of the large sides of the apertures of the electrodes of the first and the third electrode of the second quadripolar device.

3. The electron gun according to claim 1, characterized in that the first and the third electrode of the second quadripolar device are at one and the same distance d from the second electrode of the same device.

4. Electron guns according to claim 3, characterized in that the distance d and the focal lengths Fo of the second quadripolar device are connected by the relation:

$$Fo=ao+a1.d+a2.L+a3.H+a12.d.L+a23.L.H+a22.L^2+a33.H^2$$

in which:

L is the length of a large side of the apertures of the electrodes of the second quadripolar device, H is the length of a small side of the apertures of the electrodes of the second quadripolar device, ao, a1, a3, a12, a23, a22, a33 are constants.

5. The electron gun according to claim 1, characterized in that the distance d1 of the second quadripolar device from the first quadripolar device is connected to the distance d2 of the first quadripolar device from the main electron lens by the relation:

$$(Gtmin-ao-a1.d1)/a2 \leqq d2<(Vdmax-bo-b1.d1)/b2$$

in which:

Gtmin is the minimum transverse magnification,

Vdmax is the maximum dynamic voltage applied to the second quadripolar device, a0, a1, b0, b1, d1 and d2 are constants.

6. The electron gun according to claim 1, characterized in that the large sides of the apertures of the electrodes possess recesses of circular shapes whose radius R is equal to:

$$R=(H/2)/\cos(\alpha.\pi/2)$$

with:

—H: distance between the two large sides of an aperture

α: percentage of the perimeter of the circle of radius R.

* * * * *